US005577618A

United States Patent [19]

Rafferty

[11] Patent Number: 5,577,618

[45] Date of Patent: Nov. 26, 1996

[54] MOBILE AGGREGATE MATERIAL PROCESSING PLANT

[76] Inventor: Malachy J. Rafferty, Termunbeg, Carrickmore, Omagh, County Tryone, Northern Ireland

[21] Appl. No.: 301,578

[22] Filed: Sep. 7, 1994

[30] Foreign Application Priority Data

Sep. 7, 1993 [IE] Ireland ..... S93 0654

[51] Int. Cl.[6] ..... B07B 1/49

[52] U.S. Cl. ..... 209/421; 209/244

[58] Field of Search ..... 209/421, 313, 209/311, 235, 240, 241, 243, 244

[56] References Cited

U.S. PATENT DOCUMENTS

| | | | |
|---|---|---|---|
| 983,659 | 2/1911 | Titcomb | 209/241 |
| 1,785,402 | 12/1930 | Arentzen . | |
| 1,796,549 | 3/1931 | White | 209/243 |
| 3,444,987 | 5/1969 | Palmer | 198/233 |
| 4,190,526 | 2/1980 | Bachand | 209/421 |
| 4,237,000 | 12/1980 | Read et al. | 209/319 |
| 4,256,572 | 3/1981 | Read | 209/257 |
| 4,591,432 | 5/1986 | Hartl | 209/421 |
| 4,997,135 | 3/1991 | Zehr | 241/101.7 |
| 5,120,433 | 6/1992 | Osadchuk | 209/235 |
| 5,234,564 | 8/1993 | Smith | 209/241 |

FOREIGN PATENT DOCUMENTS

| | | | |
|---|---|---|---|
| 0284296 | 9/1988 | European Pat. Off. | 209/240 |
| 2207874 | 2/1989 | European Pat. Off. | 209/240 |
| 1415640 | 11/1975 | United Kingdom . | |
| 1414786 | 11/1975 | United Kingdom . | |
| 1449001 | 9/1976 | United Kingdom . | |
| 1480688 | 7/1977 | United Kingdom . | |
| 2223963 | 4/1990 | United Kingdom . | |
| WO85/03652 | 8/1985 | WIPO . | |

*Primary Examiner*—William E. Terrell
*Assistant Examiner*—T. Kelly
*Attorney, Agent, or Firm*—Jacobson, Price, Holman & Stern, PLLC

[57] ABSTRACT

An aggregate material processing plant (1) has an input hopper (5) communicating with a screen box (8) which provides three material separations. The finest material is delivered through a longitudinal conveyor (11). The two other grades are delivered to hoppers (12) (13) which feed lateral conveyors (20). Each lateral conveyor (20) has a head section (22) which pivots relative to a tail section (21) about an axis which is perpendicular to the plane of the conveyor belt (27). In addition, part of the tail section (21) pivots about an axis which extends longitudinally so that whole conveyor can be mounted in the transport position within the lateral confines of the chassis and the height of other parts of the plant.

12 Claims, 9 Drawing Sheets

MOBILE AGGREGATE MATERIAL PROCESSING PLANT

BACKGROUND OF THE INVENTION

1. Field of the Invention

The invention relates to mobile, road-hauled aggregate material processing plant such as screening plant, crushing plant for quarries, or mining plant. Examples of such plant are described in U.S. Pat. Nos. 4,237,000 (Read) and 4,256,572 (Read). In this specification, the term "aggregate material" means materials such as sand, crushed stones, bricks and any construction material, loam, mined material such as coal, or recyclable materials, timber, wood chips etc.

2. Prior Art Discussion

In an aggregate material processing plant generally, processing capacity is heavily influenced by the ability to quickly and effectively deliver the processed material away from the plant. To achieve this, it is known to provide lateral conveyors which extend transversely of the plant, possibly in addition to longitudinal conveyors. While the manner in which such lateral conveyors are connected to the plant is relatively simple for the operative position, where the processing plant is mobile major problems arise in ensuring that the overall width and height of the mobile plant is within certain dimensions when carrying such conveyors during transport. Another problem is ensuring safety, on-site, in movement of the lateral conveyors to a position for transport of the mobile plant. A still further problem is that of providing for easy and safe maintenance or repair of the lateral conveyors on-site or at a workshop.

In British Patent Specification No. GB-2223963 (J. McDonald) an arrangement is described whereby conveyors including a lateral conveyor are separated from the mobile plant and are then lifted by a loader onto upper support brackets mounted above the plant. These brackets significantly increase the height of the plant. Further, carrying separated conveyor sections on such brackets may be a safety hazard. It is a time-consuming and awkward exercise to separate the conveyor sections, mount them on a loader and lift them onto the brackets.

PCT Patent Specification No. WO 85/03652 (Powerscreen Int. Ltd.) describes a mobile screening apparatus in which there is a pair of opposed lateral conveyors extending on opposite sides of the apparatus. The conveyors are mounted on pivots which allow them to be pivoted from a laterally-extending operative position at 24° to horizontal to a transport position extending longitudinally at 10°–12° to the horizontal. Because the plant must accommodate the conveyors in the transport position in this manner, it must be of sufficient length to avoid a situation where they protect longitudinally beyond the plant. Another problem is that plant equipment mounted on the chassis must be narrow enough along the full length of the lateral conveyors so that they do not extend laterally. This aspect puts considerable design limitations on the plant, which may affect its processing capacity. For repair or maintenance of the lateral conveyors, access by personnel may be difficult and unsafe in some situations.

British Patent Specification No. GB 1,480,688 (Machines & Structures Ltd.) also describes a mobile screening plant having lateral conveyors. These conveyors are pivotable about a vertical axis through 180° for delivery of separated material to different stockpiles. The range of rotation appears to include a transport position at which they lie longitudinally alongside the processing plant. Accordingly, similar problems appear to arise as for the machine described in Specification No. WO 85/03652.

In British Patent Specification No. GB 1,449,001 (Powerscreen Int. Ltd.) a mobile separating apparatus is described which has a pair of lateral conveyors. Cross-reference is made to conveyor arrangements described in GB 1,414,786 and GB 1,415,640 (Powerscreen Int. Ltd.). In these specifications, conveyors are described which rotate about a vertical pivot axis between longitudinal and lateral positions. It appears that the longitudinal positions are used for transport, thus extending the length of the plant.

Thus, while lateral conveyors have been extensively used in the past and there have been many solutions to the problems, there are still many practical problems which arise for transport of the mobile plant. These problems can be very important where the plant is frequently moved from site to site and where the plant must be transported over large distances from the place of manufacture.

OBJECTIVES OF THE INVENTION

An object of the invention is to provide a mobile, road-hauled aggregate material processing plant which has lateral conveyors which may be moved to a transport position within the lateral and vertical dimensions of other parts of the plant without an adverse impact on plant processing capacity and effectiveness generally.

Another object is that the lateral conveyor be easily moved to the transport position in a quick, effective and safe manner.

A still further object is that the lateral conveyor may be easily moved to a maintenance position with easy access for improved safety and ease of maintenance.

SUMMARY OF THE INVENTION

The invention provides a mobile, road-hauled aggregate material processing plant in which there is a chassis and a plant support frame which supports a raw material input hopper, a material processing means having an outlet, and a processed material outfeed delivery means. At least one lateral delivery conveyor is incorporated in the outfeed delivery means and this has a tail section and a head section. A tail articulation means provides for movement of at least part of the tail section relative to the plant support frame from an operative position extending laterally of the chassis for outfeed of processed material, to a transport position extending substantially upright above the chassis and positioned with respect to the input hopper and the material processing means so that it does not project laterally beyond the chassis. The head articulation means connects the head and tail sections and allows relative movement of the head section from an operative position to the transport position with the head section extending longitudinally above the chassis and positioned with respect to the input hopper and material processing means so that it does not project laterally beyond the chassis. The lateral conveyor has a conveyor frame which is articulated by the tail and head articulation means and the conveyor is completed by a plurality of rollers mounted on the conveyor frame and an endless conveyor belt which defines a conveyor plane.

What has been achieved by the invention is movement of a lateral conveyor from an operative position to a transport position at which it does not extend laterally beyond the chassis and at which it does not need to extend any higher than other parts of the plant with little or no impact on other plant parts. The problem solved is a major one as heretofore, major difficulties have arisen eves before the mobile processing plant arrives at its destination from the manufacturers. Transport regulations and ensuring safety have caused major delays and sometimes design modifications. These problems have been overcome in a very simple manner.

The phrase "plant support frame" is intended to cover any fixed support frame which is mounted on the chassis and which supports any of the parts of the plant.

BRIEF DESCRIPTION OF THE DRAWINGS

The invention will be more clearly understood from the following description of some embodiments thereof given by way of example only with reference to the accompanying drawings in which.

DETAILED DESCRIPTION OF SOME EMBODIMENTS

Figure 1:
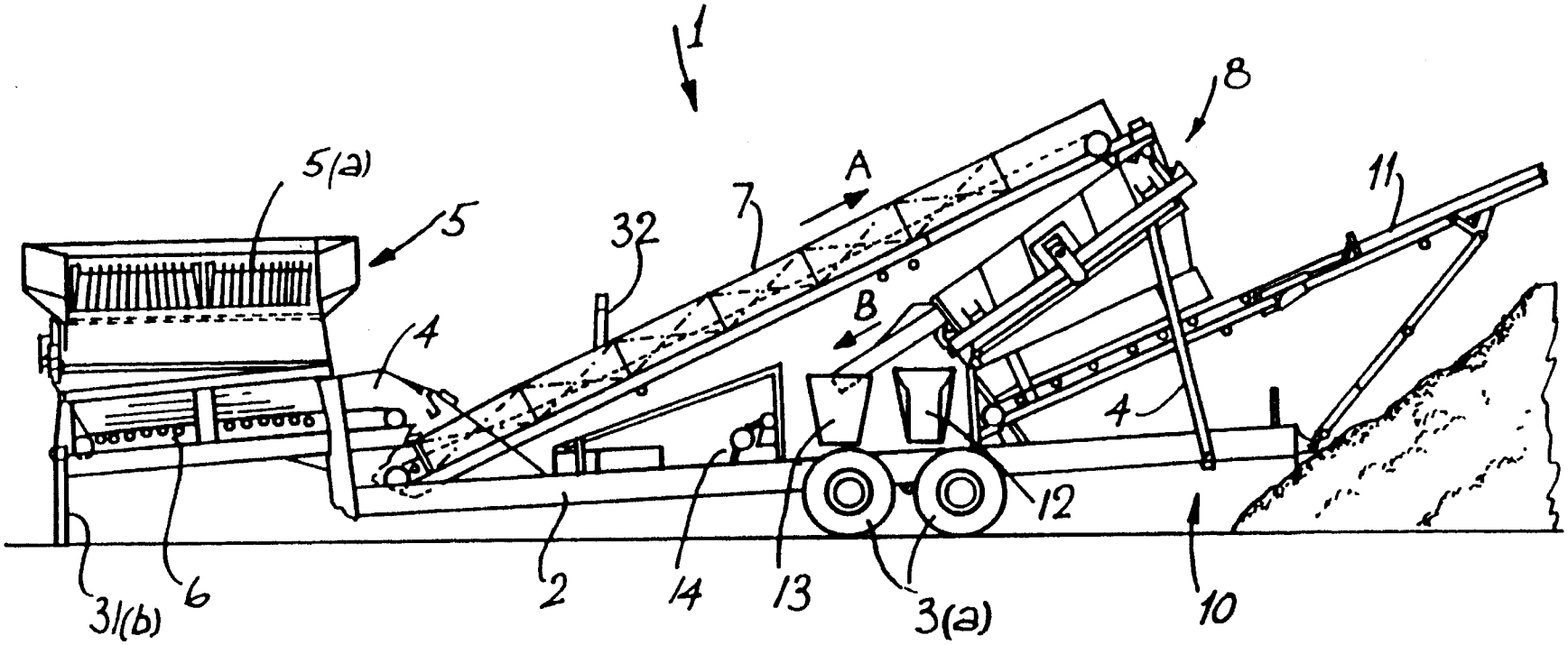
FIG. 1 is a diagrammatic side view showing part of a mobile, road-hauled aggregate material processing plant of the invention in use.
Figure 2:
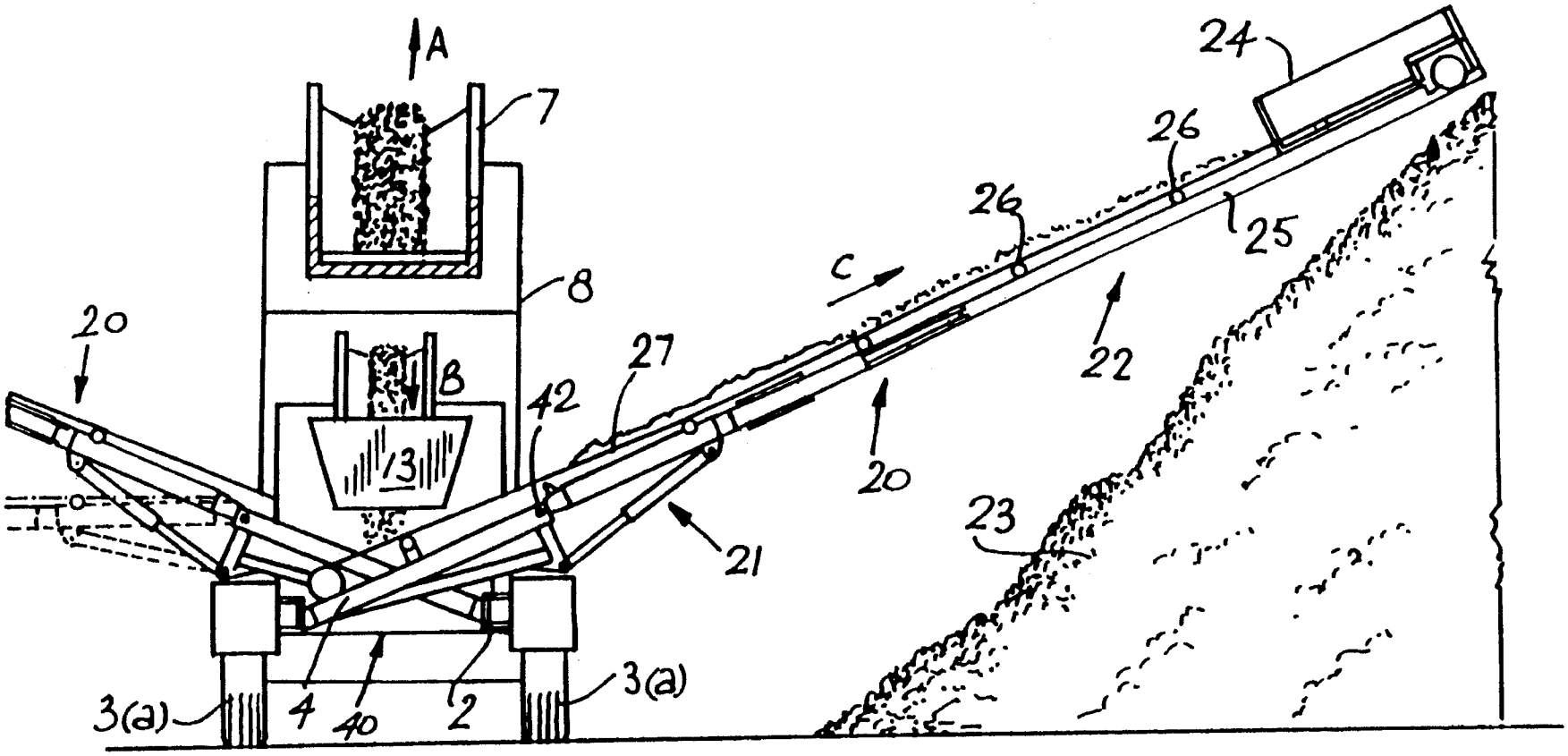
FIG. 2 is a diagrammatic, cross-sectional view of part of the processing plant showing material outfeed in the lateral direction.

Referring to the drawings, and initially to FIGS. 1 and 2 there is shown a mobile, road-hauled aggregate material processing plant of the invention, indicated generally by the reference numeral 1. The plant 1 is in this embodiment for screening and grading of aggregate materials such as stone, rubble, loam, or mined minerals. The plant 1 comprises a chassis 2 having a pair of longitudinal beams mounted on wheels 3(*a*) and supported on jack legs 3(*b*). A plant support frame 4 is mounted on the chassis 2 and in this embodiment the frame 4 takes the form of several separate sub-frames at different parts along the length of the chassis 2.

The plant 1 comprises an input hopper 5 which is a vibratory hopper having a set of eloping grid bars 5(*a*), the hopper 5 being mounted over an input hopper conveyor 6. The input hopper 5 communicates with a material processing means by way of the input hopper conveyor 6 and a main internal conveyor 7 which extends centrally and longitudinally along the plant 1 above the chassis 2. The end of the main internal conveyor 7 is mounted over a material processing means, namely a sloped screen box 8 incorporating a two-deck vibrating screen giving these sizes. Further, the plant 1 comprises a processed material outfeed delivery means 10 which is mounted on the plant support frame 4 and fed from outlets of the screen box 8.

The processed material outfeed delivery means 10 comprises a longitudinal delivery conveyor 11 which extends rearwardly of the plant 1 for delivery of processed aggregate material of the smallest graded size behind the plant 1 to forms stockpile as shown in FIG. 1. There are two other separations and these are delivered from the lower end of the screen box 8 into hoppers 12 and 13. Each of the hoppers 12 and 13 is mounted above a lateral conveyor, one extending on each side of the plant 1. An hydraulic control unit 14 is mounted on the frame 4 for supply and control of hydraulic fluid for the plant 1.

For clarity, the lateral conveyors are not shown in FIG. 1, however, they are shown in FIG. 2 where many parts of the plant 1 have been omitted so that the lateral conveyors are clearly illustrated. There is a pair of lateral conveyors 20 and each conveyor 20 comprises a tail section 21 and head section 22. The plant 1 also comprises a tail articulation means for movement of the tail section 21 and a head articulation means for movement of the head section 22. These are described in more detail below. The head section 22 delivers processed material to form a stockpile such as the stockpile 23 shown in FIG. 2. A safety cage 24 is mounted at the extremity of the head section 22 and this is mounted on a conveyor frame 25 which also supports rollers 26 for an endless conveyor belt 27. In this embodiment the endless conveyor belt 27 is of high-strength synthetic rubber composition, however, it is envisaged that any other type of endless conveyor belt such as a mesh arrangement could be used instead. The rollers 26 form a trough-like arrangement with a central lowermost roller and a pair of side rollers extending laterally and upwardly above the conveyor frame 25. This provides for self-centring of the belt 27.

In operation, material is delivered by a loader into the input hopper 5. Oversize material slides off the grid bars 5(*a*) to one side of the plant 1 and the material to be graded drops through the bars 5(*a*) onto the input hopper conveyor 6. This conveyor delivers the material to be graded onto the main internal conveyor 7 which delivers the material (arrow A, FIG. 2) to the top end of the screen box 8. The screen box 8 is inclined as illustrated in FIG. 1 and has two screen decks. Oversize material for the top screen deck is delivered to the hopper 13 (arrow B, FIG. 2), whereas intermediate material from above the lower screen deck is delivered to the hopper 12. The finest material is delivered out via the lateral conveyors 20 (arrow C, FIG. 2). Material which passes through both screen decks is delivered onto the longitudinal conveyor 11. Thus, there are three separations of the material which is suitable for grading, and in addition initial oversize material is delivered to one side of the input hopper 5. As shown in FIGS. 1 and 2 the arrangement of conveyors provides for very large stockpiles of materials to be generated, thus giving a high delivery capacity.

Figure 3:
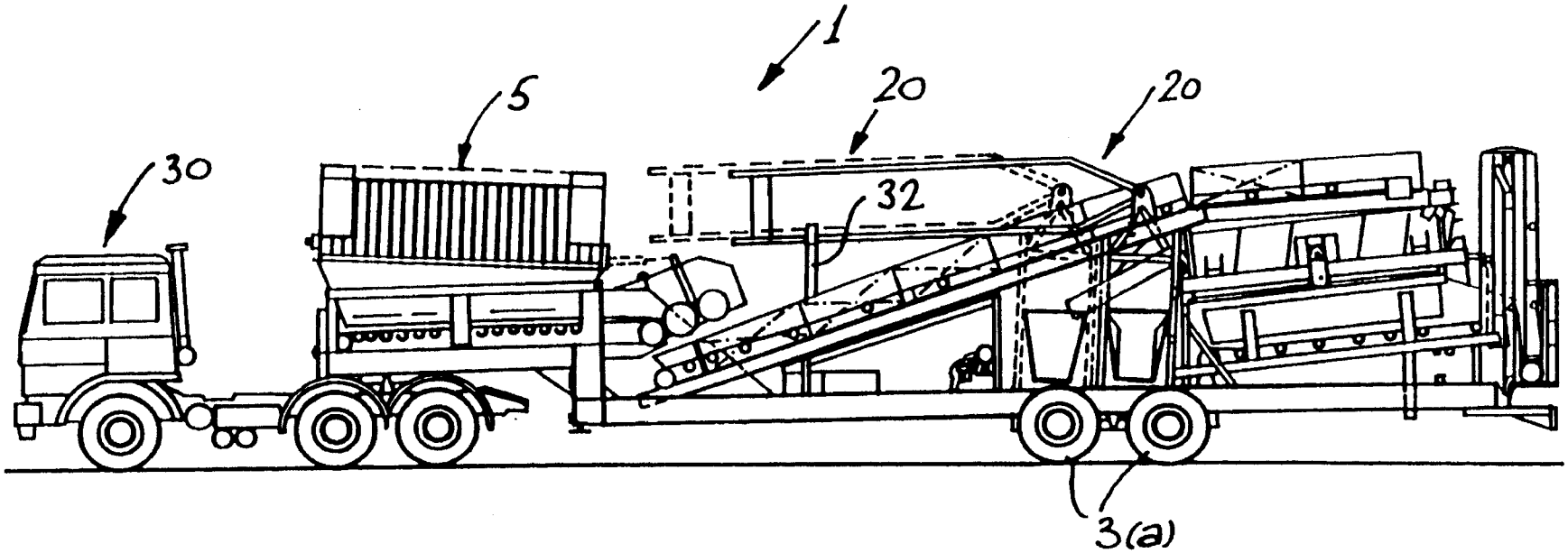
FIG. 3 is a diagrammatic side view showing the manner in which the plant is transported.
Figure 4:
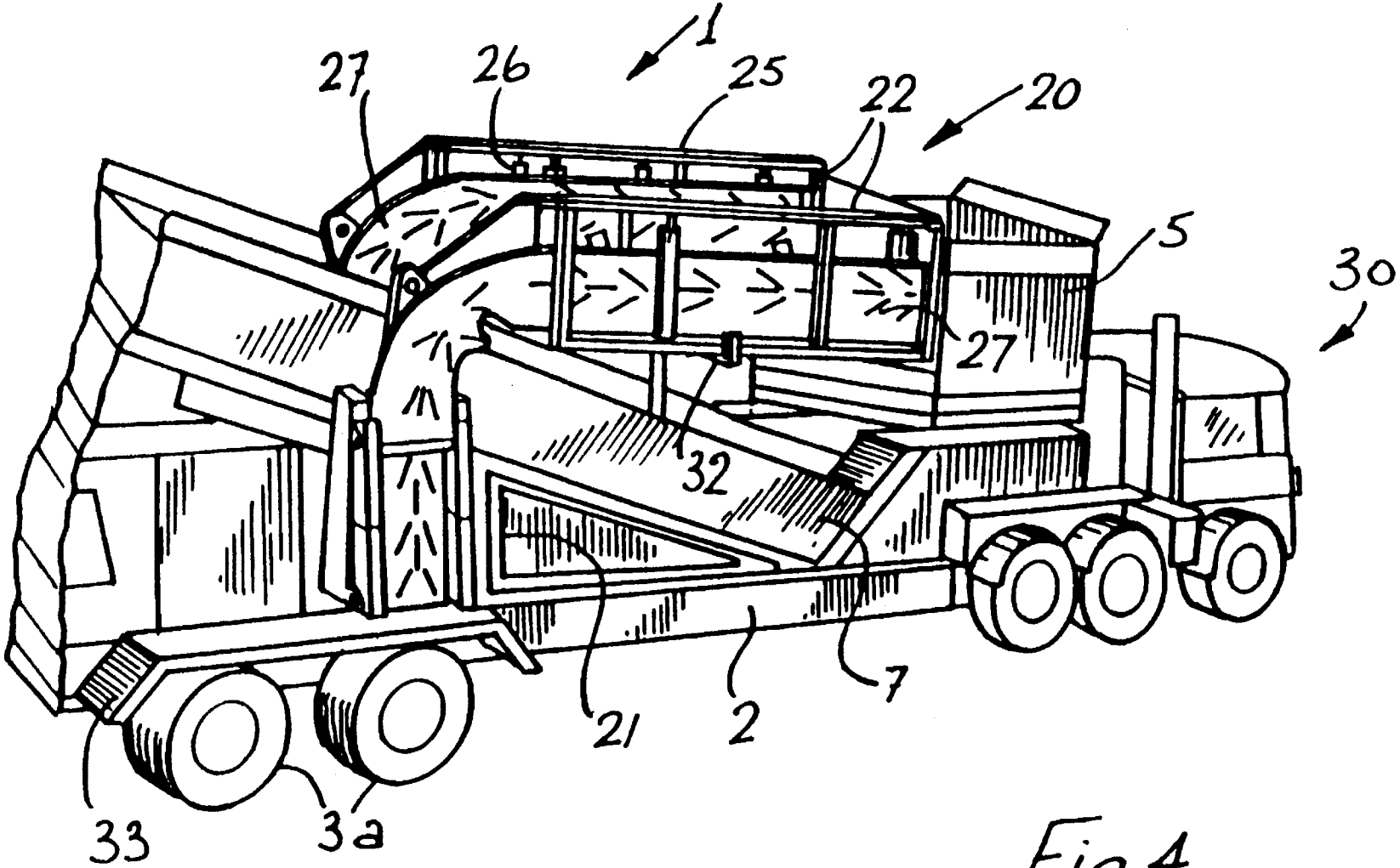
FIG. 4 is a perspective view, also showing the plant being transported.
Figure 5:
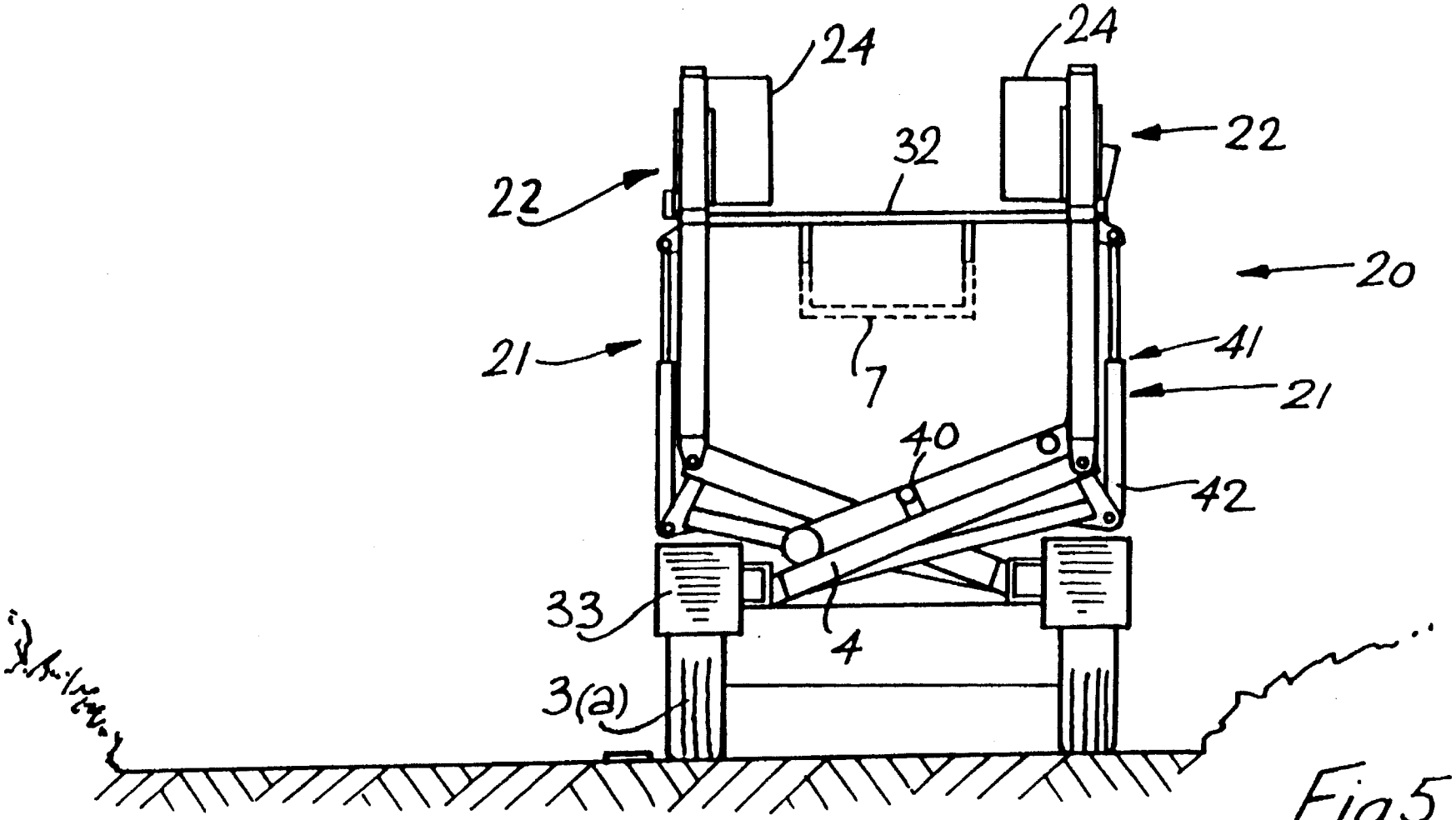
FIG. 5 is a diagrammatic cross-sectional front view showing the transport position for two lateral conveyors.

The manner in which the plant 1 is transported is shown in FIGS. 3 to 5. As shown in FIG. 3 the jack legs 3(*b*) are lifted out of the operative position and that part of the plant support frame 5 underneath the inlet hopper 5 is mounted on the filth wheel of a tractor 30. The plant 1 may then be hauled along a road on the wheels 3(*a*). As shown in FIG. 3, the longitudinal conveyor 11 is folded back on itself so that it retracts inwardly.

As is clear from all three drawings, the lateral conveyors 20 each move to a transport position where they are within the lateral confines of the chassis 2 and do not protrude above the height of the hopper 5. This is achieved by the manner in which the lateral conveyors 20 are articulated and location of the input hopper, the conveyor 7 and the screen box 8. This articulation involves the tail articulation means causing pivotal movement to an upright position above the chassis and within the lateral confines of the chassis of that part of the tail section 21 which protrudes beyond the support frame 4. A head articulation means causes pivotal motion of the head section 22 about the tail section 21 so that they are at right angles and the head section 22 extends longitudinally above the chassis and does not project laterally beyond the chassis. When in the transport position, the head section 22 of each conveyor 20 is supported on a transverse support bracket 32 which acts as a rest or seat for the conveyor and provides stability. As is clear from FIG. 4, the belt 27 has a smaller width than the rollers 26 and therefore this provides enough play for the pivoting of the head section about the tail section.

It will also be clear from FIGS. 3 to 5 that the lateral conveyors 20 are completely accommodated above the chassis and do not project laterally beyond it. This includes the safety cages 24 mounted at the extremity of each head section 22 as these project inwardly in free space above the main internal conveyor 7. Thus, it will be appreciated that there is no need to remove any parts of the conveyor before it is moved to the transport position. Both lateral conveyors 20 are within both the lateral and height dimensions of the other parts of the plant and this provides for safety in addition to convenience and efficiency. For example, as is clear from FIG. 4, the lateral conveyors 22 do not project beyond the wheel arches 33.

Referring now to FIGS. 6 to 9 inclusive, construction of both articulation means and of the lateral conveyor is shown in more detail. The tail section 21 comprises an inner, fixed part 40 and an outer pivoting part 41. The fixed part 40, as shown in FIGS. 2 and 5 is mounted directly beneath the relevant hopper 12 or 13 and is fixed in position on a part of the plant support frame 4. The pivoting part 41 is pivotally connected by pivot joints 42 to the fixed part 40. A pair of hydraulic rams 43 is mounted between the plant support frame 4 underneath the fixed part 40 and the pivoting part 41 to pivot the pivoting part 41 of the tail section 21 about a pivot axis which extends longitudinally. The pivot joints 42 and the rams 43 form an articulation means for the tail section 21.

Figure 6:
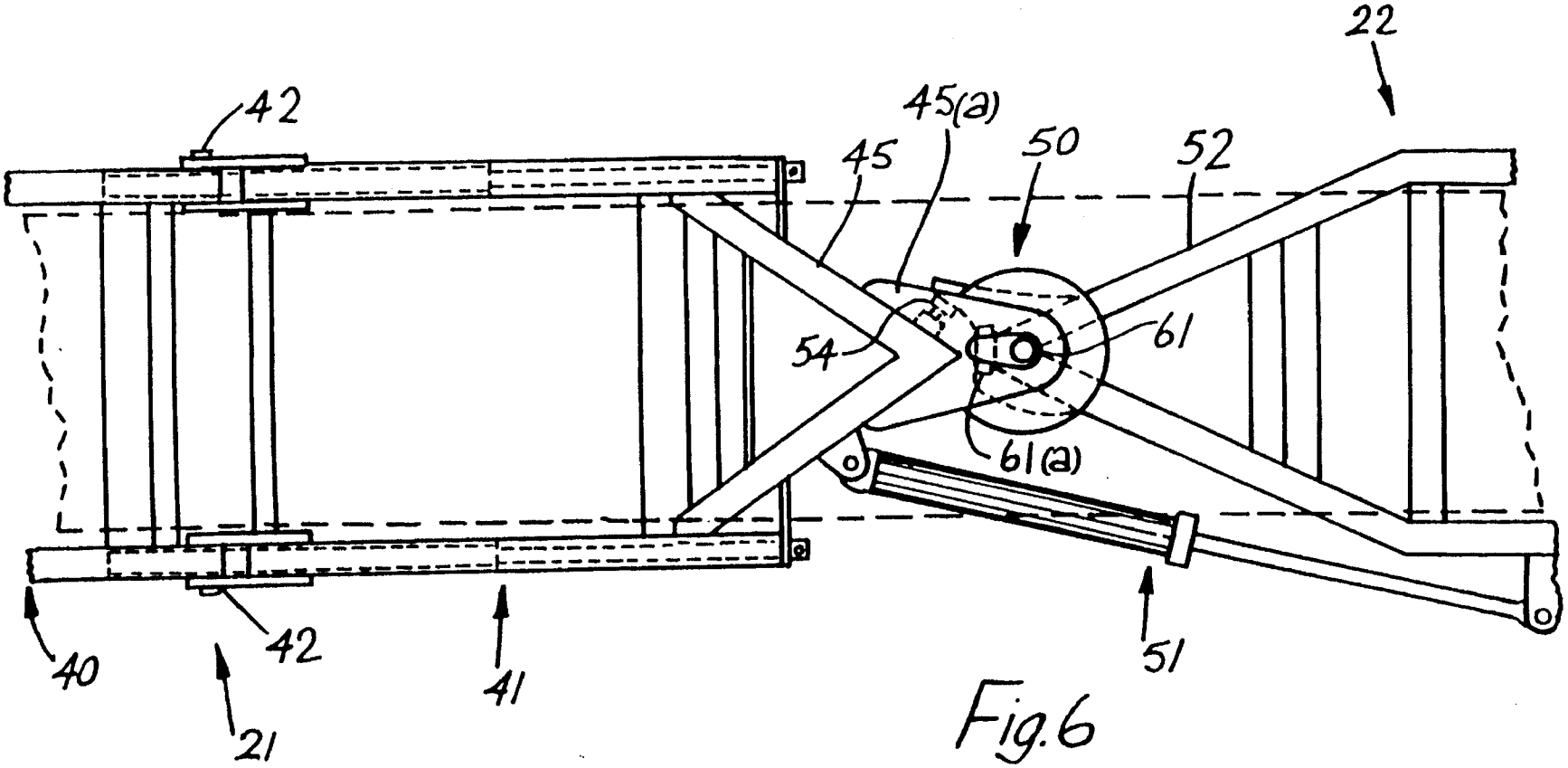
FIGS. 6 and 7 are diagrammatic plan views showing articulation of a conveyor head section.
Figure 7:
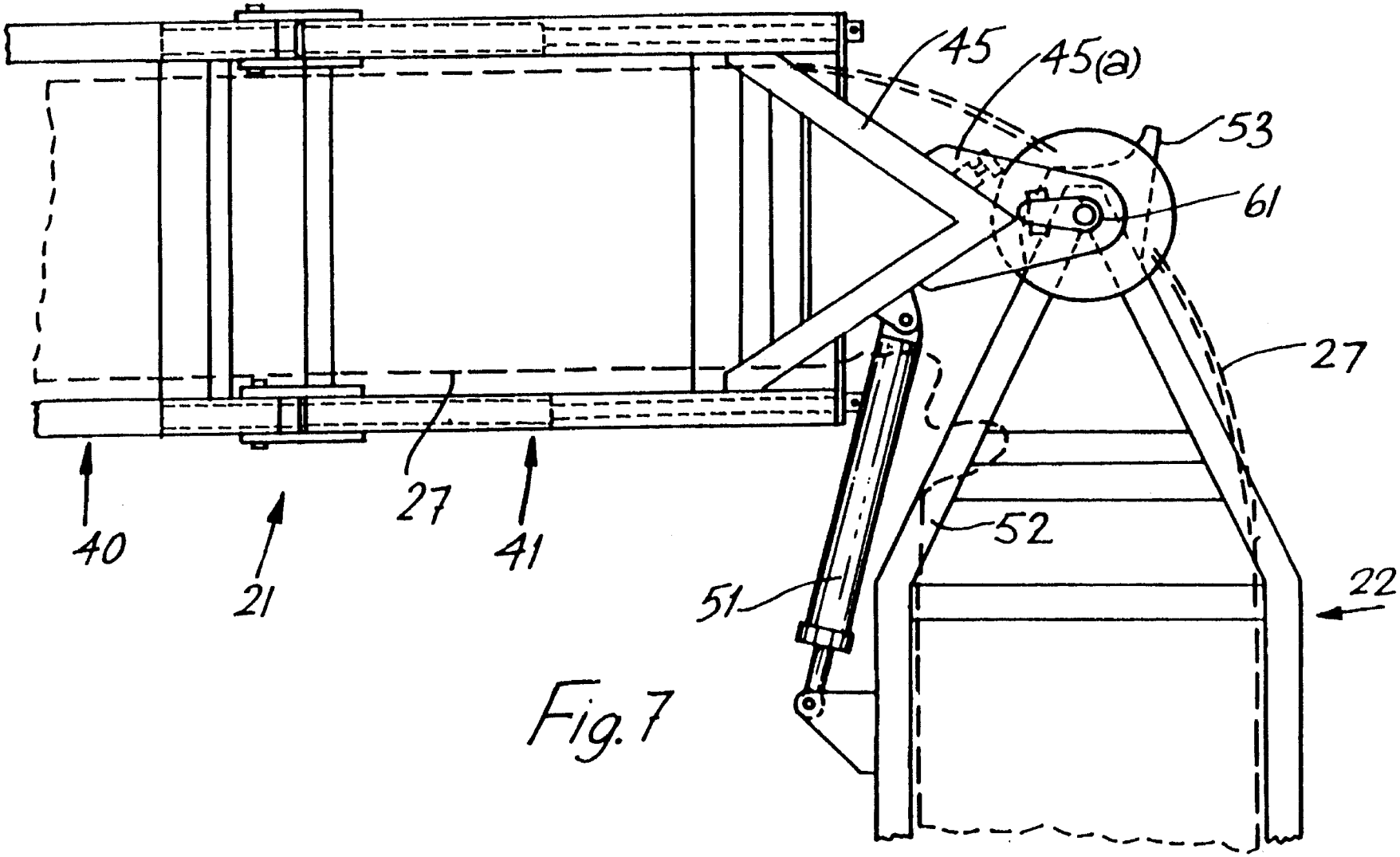

The outer extremity of the pivoting part 41 is tapered at 45 and supports a pivot joint 50. The pivot joint 50 together with an hydraulic ram 51 and a tapered part 52 of the frame of the head section 22 form part of the head articulation means. The head section 22 rotates about the tail section 21 and an axis through the joint 50 which extends perpendicularly to a plane defined by the conveyor belt 27. This rotation is between an in-line operative outfeed position as shown in FIG. 6 and a folded position as shown in FIG. 7.

Articulation of each conveyor 20 can provide three different conveyor positions. Two positions are the transport and operative positions already described. However, another position is where the pivoting part 41 of the tail section 21 extends laterally outwardly as shown in FIG. 7 with the head section 22 at right angles. In this position for the conveyor 20 both the tail and head sections 21 and 22 are substantially horizontal and are at a working height so that they can be accessed by personnel without the need to mount ladders or use cranes or other lifting apparatus. Furthermore, it will be appreciated that because the head section 22 extends longitudinally, parallel to the chassis 2, it requires very little lateral space and may be easily worked on in a workshop having limited space. For example, upon transport of the plant to the workshop it is only necessary for the rams 43 to be activated to rotate the pivoting part 41 of the tail section 21 from the upright position to a horizontal position so that all of the conveyor 41 is in a substantially horizontal position and is accessible.

Figures 8A, 8B:
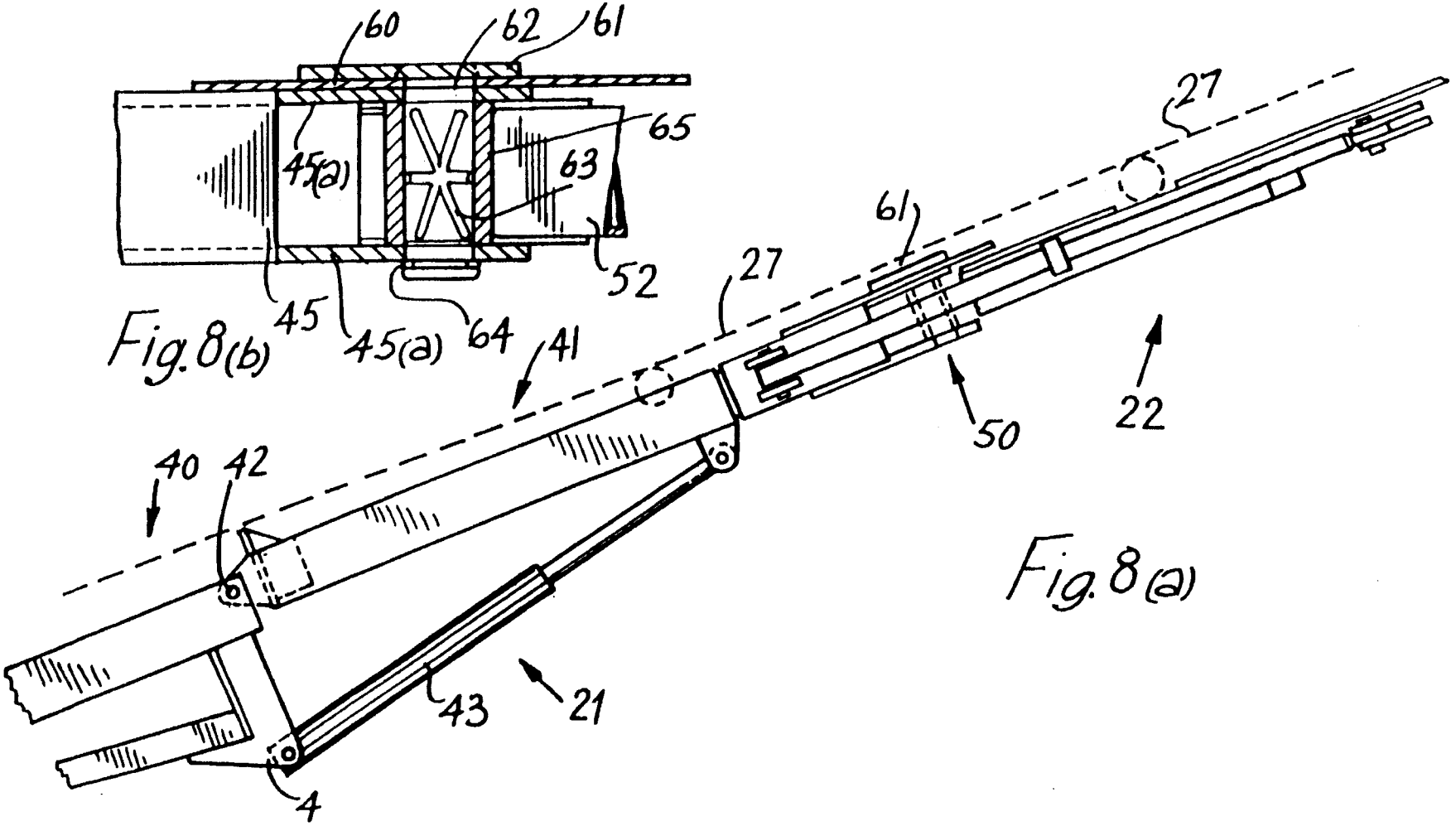
FIG. 8(*a*) is a front view of a lateral conveyor and FIG. 8(*b*) is a diagrammatic cross-sectional view showing a pivot joint for head articulation in more detail.
Figures 9A, 9B:
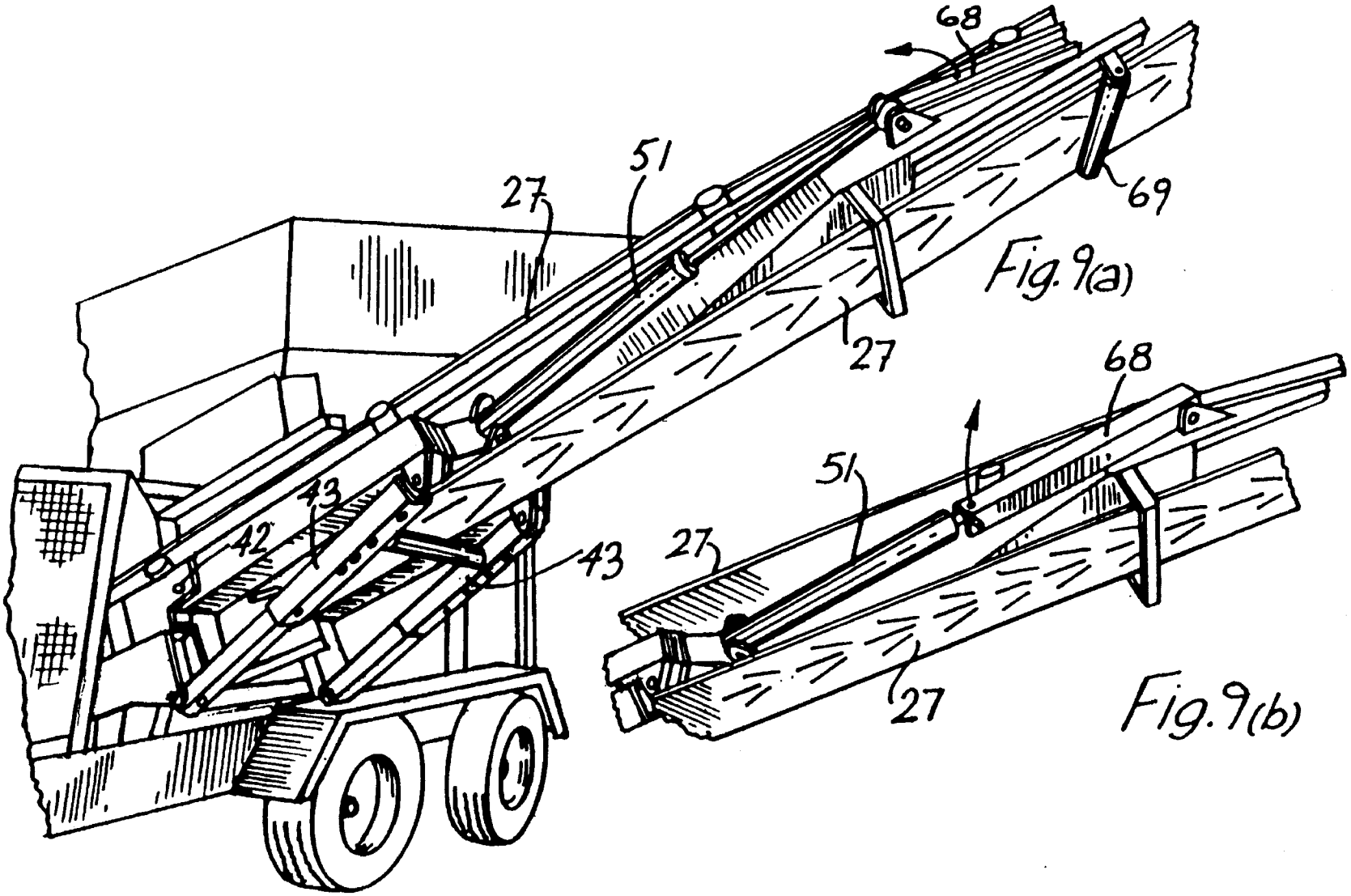
FIGS. 9(*a*) and 9(*b*) are perspective views from underneath showing a lateral conveyor with particular detail of a tail articulation arrangement.

To control movement of the head section 22 about the tail section 21, there is a fixed stop 53 mounted on the tapered portion 52 of the head section frame and this abuts against a threaded adjustable stop 54 mounted on the tail frame section 45. Details of the pivot joint 50 are shown in FIG. 8(*b*). There is a plate 60 through which a pin 60 passes, the pin 60 being welded to a holding plate 61 which is held in position by stops Gl(A) on the plate 60. The pin 62 has various lubrication grooves 63 as illustrated and is retained by a C-clip 64 in the lower of a pair of wing plates 45(*a*) welded to the tail section frame 45. A bushing 65 engages the pin 62 and the former is secured to the tapered head frame part 52. Thus, the pin 62 is fixed, while the bushing 65 rotates. As shown in FIGS. 9(*a*) and 9(*b*), there is an elongate guard 68 for the exposed piston of the ram 51 when in the operative position and this rotates to a cover position as shown in FIG. 9(*b*). These drawings also show underneath rollers 69 for the lateral conveyor 20. Although not illustrated, in detail, the rollers 26 are in a trough configuration; having opposed pairs of partially downwardly-extending rollers and a bottom roller. This allows use of a belt of a smaller width which can accommodate the head section articulation (see FIG. 4), and which is self-centring in operation.

It will be appreciated that by use of the hydraulic control unit 14 and the various hydraulic rams each of the lateral conveyors 20 may be very quickly and easily moved between the operative and transport positions and vice versa. This is achieved by simply controlling the unit 14 and there is no need to remove any part of the conveyors such as the safety cages. When in the transport position the parts of each lateral conveyor which extend beyond the pivot joints 42 are aligned so that the conveyor belt plane is vertical and in the longitudinal direction. Thus little lateral space is required, and this space is provided by appropriate location of the other plant parts. Further, each conveyor does not extend above the normal height of the plant 1 and thus transporting of the plant 1 does not cause any dimensional problems whatsoever. It will also be appreciated that by activation of the rams the conveyors may be moved between the positions very quickly and effectively. As described above, each conveyor may be moved to a maintenance position at which the plant 1 is quite compact within a maintenance workshop and all parts of the lateral conveyor are accessible by maintenance people without the need for cranes or ladders. This is a very important safety feature. Another major advantage of the invention is the fact that automatic control of the articulation of the lateral conveyor is achieved using an existing hydraulic circuit which is provided in any event for other parts of the plant 1.

The invention is not limited to the embodiments hereinbefore described. The head articulation means may rotate the head section 22 about the pivot joint 50 to different operative positions to create several stockpiles. For example, it is envisaged that there may be no drive means for articulation of the lateral conveyors as they could be moved either manually or by help of a loader to the desired positions. Where drive means is provided, At may have any suitable power plant such as an electrical generator.

It is also envisaged that articulation means can comprise different arrangements for movement of the different sections. For example the lateral conveyor may not have a fixed part and the tail section may then extend from the lateral extremity of the chassis outwardly. In this latter embodiment all of the tail section would be pivotable. Various other arrangements can be provided for movement of the conveyor to the transport position. For example, the tail section could slide relative to the plant support frame for both translational and also rotational motion. Further, the tail articulation means could comprise a universal-type joint to allow pivoting about a vertical axis for different operative lateral positions. Where drive is provided, it could alternatively be by way of motor-driven stays or slowing motors.

The conveyor belts may alternatively be of mesh construction, or indeed take the form of a set of discrete buckets, depending on the nature of the aggregate material being processed.

The mobile plant may be a mobile mining or crushing plant or any other aggregate material processing plant instead of a screening plant.

I claim:

1. A mobile, road-hauled aggregate material processing plant comprising:

a wheel mounted chassis extending in a longitudinal direction;

a plant support frame mounted on the chassis;

a raw material input hopper mounted on the plant support frame;

a material processing means mounted on the plant support frame and fed from the input hopper and having an outlet;

processed material outfeed delivery means mounted on the plant support frame and fed from the material processing means;

at least one lateral delivery conveyor incorporated in the outfeed delivery means, said conveyor comprising:
a conveyor frame tail section;
a conveyor frame head section;

a tail articulation means connecting the tail section to the support frame in such a way that at least part of the tail section is movable relative to the plant support frame from an operative position extending laterally of the chassis with respect to the longitudinal direction for outfeed of processed material, to a transport position extending substantially upright above the chassis and positioned with respect to the input hopper and material processing means so that it does not project laterally beyond the chassis;

a head articulation means connecting the head section to the tail section in such a way that the head section is movable from an operative position to a transport position with the head section extending longitudinally above the chassis and positioned with respect to the input hopper and material processing means so that it does not project laterally beyond the chassis;

a plurality of rollers mounted on the conveyor frame; and an endless conveyor belt mounted on the rollers to complete the assembly of a lateral delivery conveyor having tail and head sections, said belt defining a conveyor plane.

2. A processing plant as claimed in claim 1, wherein:

the tail articulation means comprises a pivot joint connecting at least part of the tail section to the plant support frame, said joint having a pivot axis extending substantially longitudinally and horizontally; and the head articulation means comprises a pivot joint connecting the tail and head conveyor frame sections and having a pivot axis extending substantially perpendicular to the conveyor plane.

3. A processing plant as claimed in claim 2 wherein the pivot joint of the head articulation means comprises a fixed pivot pin mounted on the conveyor frame tail section and a rotatable bushing mounted on the conveyor frame head section.

4. A processing plant as claimed in claim 1 further comprising a lateral support bracket mounted on the plant support frame for support of the lateral conveyor head section when in the transport position.

5. A processing plant as claimed in claim 1 wherein:

the conveyor rollers are arranged in a trough-like configuration comprising a central lower roller and a pair of side rollers extending laterally and upwardly with respect to the conveyor frame, said configuration providing for self-centring of the conveyor belt in operation; and the conveyor belt has a substantially smaller width than the conveyor frame for accommodation of articulation of the head section.

6. A processing plant as claimed in claim 1, wherein the lateral conveyor tail section comprises:

a fixed part mounted on the plant support frame and extending laterally above the chassis and beneath the material processing means outlet; and a pivoting part connected to the fixed part by the tail articulation means, said pivoting part being movable by the tail articulation means.

7. A processing plant as claimed in claim 1 wherein the tail and head articulation means comprise a drive means for causing movement of the lateral conveyor between the operative and transport positions.

8. A processing plant as chimed in claim 7, wherein said drive means comprises means for causing movement of the lateral conveyor to a maintenance position at which the tail section extends laterally and the head section extends longitudinally parallel to and spaced-apart from the chassis.

9. A processing plant as claimed in claim 7 wherein said tail articulation means comprises an hydraulic ram drive means mounted between the plant support frame and the tail section and said head articulation means comprises an hydraulic ram drive means mounted between the tail and head sections.

10. A processing plant as claimed in claim 9, wherein said head articulation means comprises:

a pivot joint connecting the tail and head conveyor frame sections;

a double-acting hydraulic ram mounted on one side of the pivot joint for articulation of the head section about the tail section; and a pair of inter-engaging stop members mounted on the opposed side of the pivot joint to limit the degree of articulation of the head section about the tail section.

11. A processing plant as claimed in claim 10 wherein a stop member is adjustable to provide different limit articulation positions.

12. A mobile, road-hauled aggregate material processing plant comprising:

a wheel mounted chassis extending in a longitudinal direction;

a plant support frame mounted on the chassis;

a power plant mounted on the chassis;

a raw material input hopper mounted on the plant support frame;

a material processing means mounted on the plant support frame and fed from the input hopper and having an outlet;

processed material outfeed delivery means mounted on the plant support frame and fed from the material processing output means;

at least one lateral delivery conveyor incorporated in the outfeed delivery means, said conveyor comprising:

a conveyor frame tail section;

a conveyor frame head section;

tail articulation means comprising:

a pivot joint in the tail section; and driving means connected to the power plant and comprising means for moving at least part of the tail section between a combined material outfeed and maintenance position extending laterally with respect to the longitudinal direction, and a tail section transport position with at least part of the tail section extending substantially upright above the chassis and positioned with respect to the input hopper and the material processing means so that it does not project laterally beyond the chassis;

a head articulation means comprising:

a pivot joint connecting the tail and head sections; and driving means connected to the power plant and comprising means for moving the head section between an operative position and a position substantially perpendicular to the tail section to provide a maintenance position with the tail section extending laterally and to provide a transport position with the tail section at the tail section transport position;

a plurality of rollers mounted on the conveyor frame; and an endless conveyor belt mounted on the rollers to complete the assembly of a lateral delivery conveyor having tail and head sections, said belt defining a conveyor plane.

* * * * *